United States Patent [19]

McAbee et al.

[11] Patent Number: 4,658,103

[45] Date of Patent: Apr. 14, 1987

[54] DISTRIBUTOR FOR MULTI-CYLINDER ENGINE

[75] Inventors: MacPatrick McAbee, 3136 Cottage Grove, Des Moines, Iowa 50311; Deloss J. Biddle, Urbandale, Iowa

[73] Assignee: MacPatrick McAbee, Des Moines, Iowa

[21] Appl. No.: 826,989

[22] Filed: Feb. 7, 1986

[51] Int. Cl.[4] ..... H01H 19/04

[52] U.S. Cl. ..... 200/19 DC; 200/19 DR; 123/146.5 A; 123/595

[58] Field of Search ..... 123/146.5 A, 595; 200/19 R, 19 A, 19 DC, 19 DR, 23, 24, 25, 26, 27 R, 27 A

[56] References Cited

U.S. PATENT DOCUMENTS

| | | | |
|---|---|---|---|
| 1,447,745 | 3/1923 | Atkinson | 200/25 |
| 1,566,888 | 12/1925 | Luckeman | 200/20 |
| 2,766,338 | 10/1956 | Jamieson et al. | 200/24 |
| 2,997,552 | 8/1961 | Silverschotz | 200/24 |
| 3,270,150 | 8/1966 | Stevens | 200/24 |
| 3,506,796 | 4/1970 | Roschilla | 200/19 A |
| 4,121,064 | 10/1978 | Nakajima et al. | 200/19 A |
| 4,315,487 | 2/1982 | Wyatt, Sr. et al. | 200/19 DC |

*Primary Examiner*—A. D. Pellinen
*Assistant Examiner*—Morris Ginsburg
*Attorney, Agent, or Firm*—Zarley, McKee, Thomte, Voorhees & Sease

[57] ABSTRACT

The distributor of the present invention includes a housing having condenser and points therein and having a rotor adapted to actuate the points for producing intermittent pulses of current at an outlet connector. A dielectric disk is attached to the rotor and is adapted to rotate in unison therewith. The upper surface of the disk includes a conductive sheet which covers only a portion of the upper surface of the disk. A cap is mounted over the distributor housing and includes a pair of contact points which are adapted to be engaged by the conductive sheet on the disk during rotation of the disk. The two contact points include leads which lead to the spark plugs of the engine. A single discharge coil includes a discharge post which is connected to a brush within the distributor cap. The brush extends downwardly through the cap and is in electrical connection with the conductive sheet at all times during rotation of the conductive sheet. The discharge coil also includes an input connection which is connected to the output of the distributor for receiving pulses of electricity therefrom.

2 Claims, 4 Drawing Figures

DISTRIBUTOR FOR MULTI-CYLINDER ENGINE

BACKGROUND OF THE INVENTION

The present invention relates to a distributor for a multi-cylinder engine, and particularly to a distributor for use with a multi-cylinder engine such as the two cylinder engines commonly used in motorcycles.

Present motorcycle engine distributors include a dual discharge coil which has two discharge posts thereon. The coil is actuated intermittently and in response to this actuation, the coil delivers an output impulse of energy simultaneously to both of the two discharge posts. The discharge posts are connected to the sparkplugs of the cylinders.

The result of the above configuration is that the sparkplugs for both of the two cylinders are fired simultaneously. When the sparkplugs are fired simultaneously, one of the cylinders is in its power stroke and the other of the cylinders is in the exhaust portion of its stroke. The result of firing both cylinders at the same time is that the engine runs unevenly and noisely. Furthermore, the actuation of both sparkplugs at the same time reduces the efficiency of the engine since one of the cylinders is always firing on the exhaust portion of its stroke.

Therefore, a primary object of the present invention is the provision of an improved distributor for a multi-cylinder engine.

A further object of the present invention is the provision of a distributor which can be utilized in combination with a single discharge coil rather than a dual discharge coil as in prior devices.

A further object of the present invention is the provision of an improvement to a distributor which can be used to modify present distributors by merely replacing the distributor cap on present distributors and inserting a disk which mounts on the top of the rotor of the present distributor.

A further object of the present invention is the provision of an improved distributor which is efficient in operation, durable in use and economical to manufacture.

SUMMARY OF THE INVENTION

The present invention involves replacing several components in present distributors. To modify present distributors to incorporate the present invention, it is necessary first to remove the distributor cap. Within the distributor housing are the condenser, rotor, and contact points. The present invention contemplates placing a disk over the rotor, and keying the disk to the rotor so that it will rotate in unison therewith. The disk is made of dielectric material, and the upper surface of the disk includes a wedge-shaped piece of conductive material. A new distributor cap is provided which includes a pair of contact points on the undersurface thereof. These contact points are positioned so as to be engaged by the conductive sheet during rotation of the disk beneath the new distributor cap. A brush extends downwardly through the center of the distributor cap and is in electrical contact with the conductive sheet of the disk at all times during rotation of the disk.

A single discharge coil includes a single outlet post which is connected to the brush located in the center of the distributor cap. The discharge coil is also connected to the outlet portion of the distributor from the circuitry connecting the condenser and points.

In operation, during rotation of the rotor within the distributor, intermittent surges of current are sent to the single discharge coil. The discharge coil then transmits pulses of electricity to the brush located in the center of the distributor cap. These surges of electricity are conducted downwardly through the brush to the conductive sheet located on the top of the disk. The disk rotates in unison with the rotor, and consequently the conductive sheet on the top of the disk moves into contact with each of the plug contacts one at a time so as to transmit pulses of electricity one at a time to each of the two sparkplugs. The result of this arrangement is that each of the sparkplugs are actuated one at a time rather than simultaneously as in prior devices.

DETAILED DESCRIPTION OF THE PREFERRED EMBODIMENT

Figure 1:
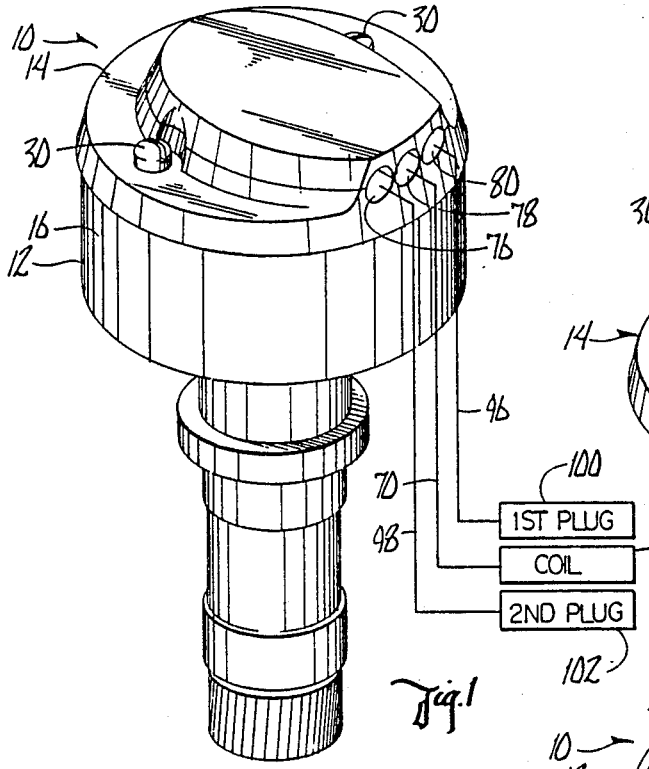
FIG. 1 is a perspective view of the distributor as modified by the invention.

Referring to the drawings, the numeral 10 generally refers to the distributor of the present invention. Distributor 10 includes a lower housing 12 and a distributor cap 14. Housing 12 includes a circular sidewall 16, and a bottom wall 18 which together form a distributor compartment 20. Mounted in the bottom of compartment 20 is a circular base plate 22 which includes a pair of arcuate slots 24 therein. A pair of bolt connectors 26 include bottom portions 28 which extend through slots 24 and which are threadably received in the bottom wall 18 of distributor housing 12. The upper portions of bolt connectors 26 include hollow threaded receptacles for receiving bolts 30 which extend through cap 14 and which hold cap 14 in covering relation over the upper end of sidewall 16 so as to completely enclose compartment 20.

A cam shaft 32 rotatably extends upwardly through bottom wall 18 and through base plate 22, and includes a rotor 34 mounted on its upper end. Rotor 34 includes a nut 36 on its upper surface, and includes a pair of oppositely positioned cam lobes 38, 40.

Mounted to base plate 22 is a fixed contact point 42 which is grounded through the distributor housing. Also mounted to plate 22 is a movable contact point 44 which is biased toward contact point 42 by a spring 46. A cam follower 48 is connected to movable contact point 44 and is adapted to bear against the cam lobes 38, 40 of rotor 34 during rotation of rotor 34. As each cam lobe 38, 40 engages cam follower 48, it causes contact point 44 to move away from contact point 42 for a short period of time.

A condenser 50 is mounted on base plate 22 and is grounded through the distributor housing. Condenser 50 is connected to a terminal 52 which is in electrical connection with spring 46 and which provides electrical connection to movable contact 44. An outlet lead 54 is also connected to terminal 52 and leads outwardly through housing 16 to an outlet terminal 56 outside housing 12.

Connected to outlet terminal 56 is a connecting wire 58 which is also connected to an inlet terminal 60 on a single discharge coil 62. Coil 62 includes a second coil terminal 64 which is adapted to be connected to an electrical power source 66. Coil 62 includes a single discharge post 68 which is adapted to send pulses of current to a discharge coil wire 70 which leads to the center of distributor cap 14.

Figure 2:
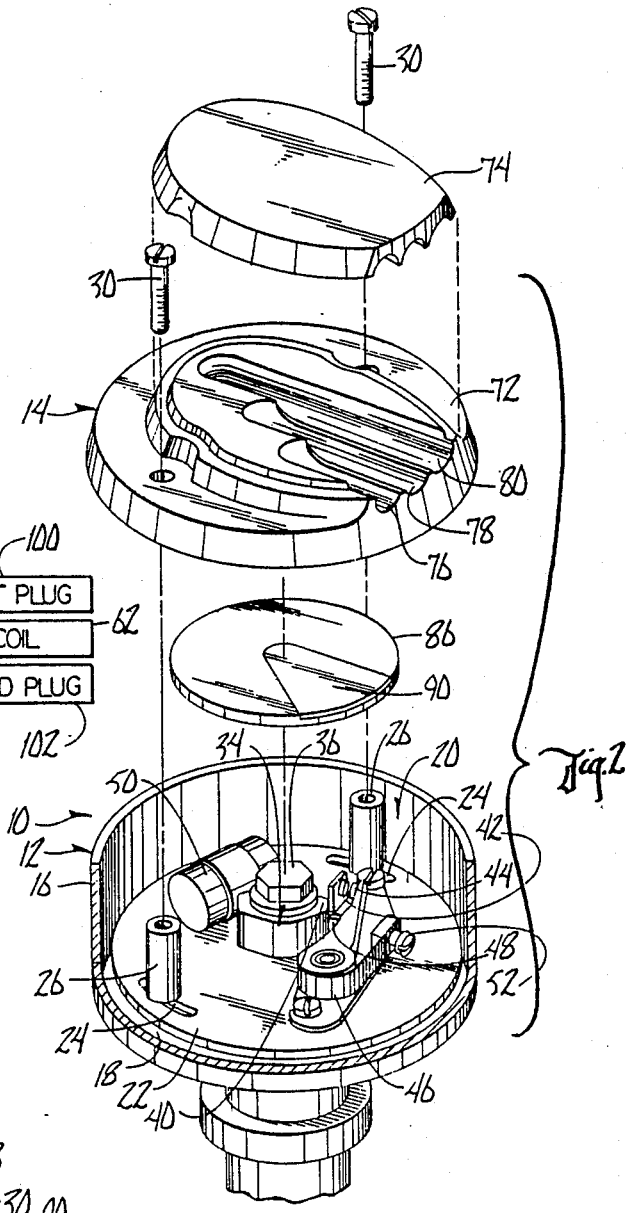
FIG. 2 is an exploded perspective view showing the various components of the distributor.
Figure 3:
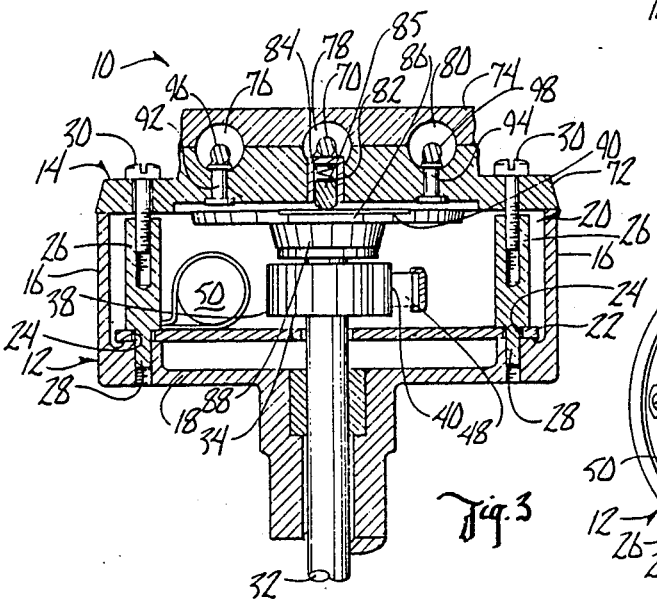
FIG. 3 is a sectional view taken along line 3—3 of FIG. 1.
Figure 4:
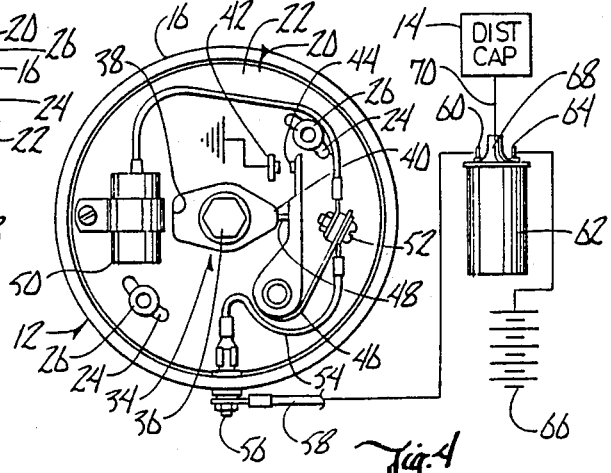
FIG. 4 is a schematic diagram showing the interconnection of the various components of the present invention.

As can be seen in FIGS. 1 and 2, distributor cap 14 includes a lower cap member 72 and an upper cap member 74. Upper cap member 74 is glued or otherwise secured over lower cap member 72 and forms three channels 76, 78, 80 therebetween. The central channel 78 receives the coil wire 70 which extends inwardly to the center of cap 14 where it is in electrical connection with a coil spring 82 which extends downwardly through a central opening 84 in cap 14. A cylindrical carbon brush 85 is slidably mounted within central opening 84 and is urged downwardly by coil spring 82.

Mounted over the nut 36 of rotor 34 is a circular dielectric disk 86 which has a receptacle 88 adapted to fit in mating engagement over nut 36 so that disk 86 will rotate in unison with rotor 34. On the upper surface of disk 86 is a pie-shaped or wedge-shaped conductive sheet 90 which extends from the center of disk 86 radially outwardly to the outer periphery thereof. The width of conductor sheet 90 can be varied, but should be chosen so that conductor sheet 90 can move into electrical contact with a pair of sparkplug contacts 92, 94 mounted on the under surface of cap 14. Contacts 92, 94 comprise rivetlike members which extend upwardly into the channels 76, 80 in cap 14. A pair of sparkplug wires 96, 98 are electrically connected to the upper ends of contact points 92, 94 and extend outwardly through channels 76, 80 for electrical connection to a pair of sparkplugs 100, 102.

In order to adapt a conventional motorcycle carburetor to the present invention, all that is necessary is to remove the conventional distributor cap and place the new disk 86 in mated relationship over the nut 36 of rotor 34. Next, the new distributor cap 14 of applicant's invention is attached by means of bolts 30 over the top of the distributor housing 12. The single discharge coil 62 is then connected to the output terminal 56 of the distributor housing. Next, discharge wire 70 is connected to discharge post 68 of coil 62 and sparkplug wires 96, 98 are connected to the two sparkplugs 100, 102.

In operation, the rotor 34 rotates, and lobes 38, 40 alternatively engage and disengage movable contact 44. Each time one of lobes 38, 40 engages contact 44, it causes contact 44 to move from a first position in electrical contact with fixed contact 42 to a second position spaced from contact 42. This happens twice with each rotation of rotor 34.

Each time that contact 44 is moved out of contact with contact 42, there is delivered an electrical impulse to outlet terminal 56, and this electrical impulse is transmitted to discharge coil 62. Discharge coil 62 then sends an impulse through wire 70 to the distributor cap 14 and downwardly through brush 85 to the center of rotating disk 86. Brush 85 is positioned over the rotational axis of disk 86 and is in electrical contact with the inner radial end of conductive sheet 90. Continued rotation of disk 86 causes conductive sheet 90 to move into electrical contact with the sparkplug contacts 92, 94. However, the conductive sheet 90 moves into contact with contacts 92, 94 one at a time so that current is directed only to one sparkplug at a time.

Thus, it can be seen that the distributor of the present invention causes sparkplug 100 to be actuated, but does not simultaneously cause sparkplug 102 to be actuated. As the disk continues its rotation, the distributor causes the second sparkplug 102 to be actuated, while the first sparkplug 100 is deactuated.

The device is simple in construction, and provides for easy and quick modification of conventional distributors utilized for motorcycles and the like. The original contact points, rotor, condenser, and lower portion of the distributor housing remain intact during the modification, and the new disk 86, distributor cap 14, and single discharge coil 62 are added as described above. Thus, it can be seen that the device accomplishes at least all of its stated objectives.

What is claimed is:

1. An improvement for an ignition system for an engine having at least first and second sparkplugs; a distributor comprising a distributor housing containing a rotor, a stationary contact point, a movable contact point, and spring means normally holding said movable contact point in a closed position in contact with said stationary contact point, said movable contact point being yieldably movable to an open position in spaced relation to said stationary contact point, said rotor having two lobes and being rotatably mounted for causing said two lobes to engage said movable contact point and cause said movable contact point to move to said open position twice during each revolution of said rotor; an electrical power circuit connected to said contact points and including an outlet connection for causing electrical current to be introduced to said outlet connection each time said movable contact point is moved to said open position; wherein the improvement comprises:

a single discharge coil having an inlet terminal connected to said outlet connection of said power circuit and having a single discharge post;

a circular dielectric disk having an upwardly presented circular surface and having connection means integral with said disk and being in direct retentive engagement with said rotor for causing rotation of said disk in unison with said rotor;

a pie-shaped conductive sheet having a narrow end and a wide end and being attached to said upwardly presented circular surface of said disk, with said narrow end located at the center of said disk and with said wide end located adjacent the outer circumference of said disk;

a distributor cap detachably secured in fixed relation to said distributor housing, said cap comprising a coil wire connected to said discharge post of said discharge coil, a first sparkplug wire connected to said first sparkplug, and a second sparkplug wire connected to said second sparkplug, said distributor cap having a downwardly presented surface, first and second sparkplug contacts and a central contact means being mounted on said downwardly presented surface, said first and second sparkplug contacts being connected to said first and second sparkplug wires and said central contact means being connected to said coil wire;

said central contact means being in electrical contact with said narrow end of said pie-shaped conductive sheet at all times during rotation of said disk in unison with said rotor;

said first and second sparkplug contacts being positioned to be contacted sequentially one at a time by said wide end of said pie-shaped conductive sheet during each revolution of said disk in unison with said rotor;

said wide end of said pie-shaped conductive sheet being sufficiently wide and being positioned relative to said rotor and relative to said first and second sparkplug contacts so as always to be in electrical contact with one of said first and second sparkplug contacts whenever said rotor moves said movable contact point to said open position.

2. The improvement according to claim 1 wherein said central contact means of said distributor cap comprises a central opening in said cap, a cylindrical carbon brush slidably mounted in said central opening, and brush spring means yieldably urging said brush into frictional engagement with said narrow end of said pie-shaped conductor sheet.

* * * * *